US005423540A

United States Patent [19]

Taxon

[11] Patent Number: 5,423,540

[45] Date of Patent: Jun. 13, 1995

[54] ADJUSTABLE SLOT MACHINE REEL MOUNTING ASSEMBLY

[75] Inventor: Thomas N. Taxon, Henderson, Nev.

[73] Assignee: Bally Gaming International, Inc., Las Vegas, Nev.

[21] Appl. No.: 250,188

[22] Filed: May 27, 1994

[51] Int. Cl.[6] ..... G07F 17/34

[52] U.S. Cl. ..... 273/143 R

[58] Field of Search ..... 273/143 R, 138 A

[56] References Cited

U.S. PATENT DOCUMENTS

| | | | |
|---|---|---|---|
| 3,610,629 | 10/1971 | Pecksen | 273/143 R |
| 3,913,922 | 10/1975 | Richards et al. | 273/143 R |
| 4,037,845 | 7/1977 | Hooker | 273/138 A |
| 4,071,246 | 1/1978 | Hooker | 273/143 R |
| 4,200,291 | 4/1980 | Hooker | 273/143 R |
| 4,249,737 | 2/1981 | Hancherick | 273/143 R |
| 4,261,571 | 4/1981 | Ito | 273/143 R |
| 4,262,906 | 4/1981 | Heywood | 273/143 R |
| 4,358,114 | 11/1982 | Burnside | 273/143 R |
| 4,430,903 | 2/1984 | Hooker et al. | 74/153 |
| 4,440,036 | 4/1984 | Hooker et al. | 74/153 |
| 4,505,167 | 3/1985 | Nicolaus | 74/577 |
| 5,102,136 | 4/1992 | Heidel et al. | 273/143 R |

FOREIGN PATENT DOCUMENTS

| | | | |
|---|---|---|---|
| 0498029 | 7/1991 | European Pat. Off. | 273/143 R |
| 462952 | 4/1937 | United Kingdom | 273/143 R |
| 2160345 | 5/1985 | United Kingdom | 273/143 R |
| 2156565 | 10/1985 | United Kingdom | 273/143 R |
| 2182478 | 5/1987 | United Kingdom | 273/143 R |

*Primary Examiner*—Benjamin H. Layno
*Attorney, Agent, or Firm*—Jenner & Block

[57] ABSTRACT

In a reel mounting assembly for a slot machine, an adjustable reel support is provided, enabling an operator to adjust the stopping position of the reel, and hence the play symbols, with respect to a pay line. The adjustment may be conveniently performed from the front of the machine without tools. A threaded pin is mounted on a frame support and a reel support is pivotally mounted on the frame support. The pin is inserted through an arcuate slot on the reel support. The reel mounting assembly also includes a tab on the reel support which can be used to adjust the rotational position of the reel. After the reel adjustment has been completed, the reel support is held in place by a wing nut threaded on to the pin.

12 Claims, 1 Drawing Sheet

ADJUSTABLE SLOT MACHINE REEL MOUNTING ASSEMBLY

TECHNICAL FIELD

The invention relates to the field of slot machines and in particular to slot machine reel mounting assemblies.

BACKGROUND OF THE INVENTION

Traditionally, slot machines include a number of rotating reels each having an outer circumferential reel strip printed with a number of play symbols usually depicting items such as fruit, playing cards or other symbols. The reels are located in a side-by-side relationship for independent movement about a common axis. In the more modern machines, each of the reels is individually driven by a stepper motor that serves to rotate the reels about the common axis.

Slot machine play is initiated when a player either pulls a handle or pushes a button on the slot machine. Such player action, in turn, triggers the start of the reel motors which rotate the reels. The reels are then stopped at random positions, usually under control of a microprocessor. Upon completion of the rotation of the reels, the microprocessor determines if the player has won a payout according to the given combinations of the play symbols displayed along a pay line on a reel display window.

It is desirable that the symbols on the reels have precise alignment with the pay line. One of the major problems encountered during the manufacture and maintenance of slot machines is to accurately align the centers of the play symbols with the pay line. In most slot machines, this requires a time-consuming and tedious adjustment of a number of inaccessible elements within the machine housing. As a result, adjusting the alignment of the reels during the manufacture of slot machines as well as the maintenance of slot machines results in significant costs to the industry.

An improved adjustable reel mounting assembly is disclosed in U.S. Pat. No. 5,102,136. This reel mounting assembly includes a reel support member pivotally connected to an upright support member, a biasing spring, and an actuator. The spring produces a forward bias force on the reel support member. The effect of the spring is offset by the actuator. The actuator consists of a bolt or screw inserted through an aperture on the front of the upright support member. The end of the bolt or screw is received into a receptacle in the reel support member. Using a tool, such as a screwdriver, an operator is able to adjust the rotational position of the reel by rotating the bolt or screw to move the reel support member. The actuator adjusts the position of the reel support member with respect to the upright support member, and consequently, adjusts the rotational position of the reel with respect to the pay line. Between adjustments, the actuator is held in place by the spring.

While such an assembly does allow adjustment of the play symbols from the front of the machine, this configuration is relatively complex and requires a tool to effect the adjustment.

SUMMARY OF THE INVENTION

It is therefore an object of the present invention to provide a reel mounting assembly for a slot machine having a simplified mechanism for adjusting the angular or rotational position of the reel from the front of the machine so as to align play symbols on the reel with a pay line.

It is a further object of the present invention to provide a slot machine reel mounting assembly in which the angular or rotational position of the reel can be adjusted without tools to align play symbols on the reel with a pay line.

DETAILED DESCRIPTION OF THE INVENTION

Figure 1:
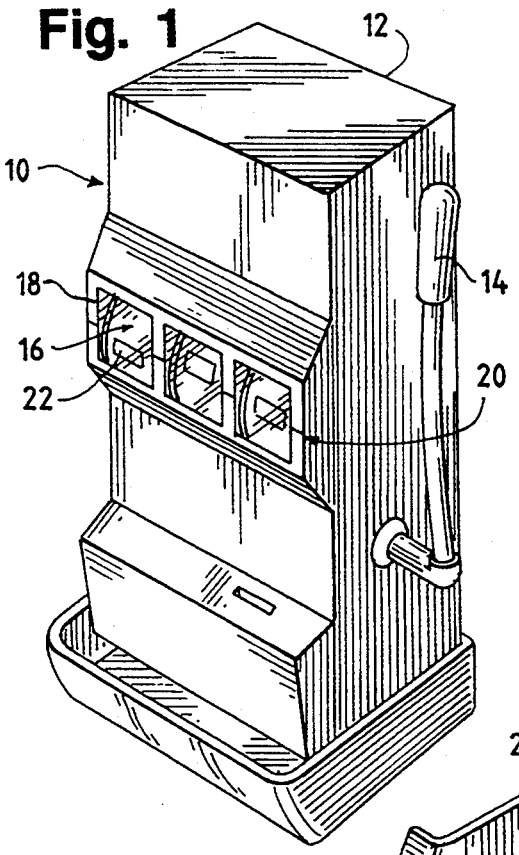
FIG. 1 is a perspective view of a conventional slot machine.

A conventional slot machine 10 having a housing 12, as illustrated in FIG. 1, normally uses a handle 14 or push button (not shown) to initiate operation of the slot machine. The user pulls the handle 14 or pushes the button thereby setting into rotation a group of symbol bearing reels shown generally at 16. Upon completion of the operation, the reels 16 come to a stop and display in a display window 18 located in the front of the housing 12 the results of that particular operation. A pay line 20 located on the window 18 is used to indicate the winning positions of the play symbols 22 on the reels. The reels 16 are secured within the slot machine housing 12.

Figure 3:
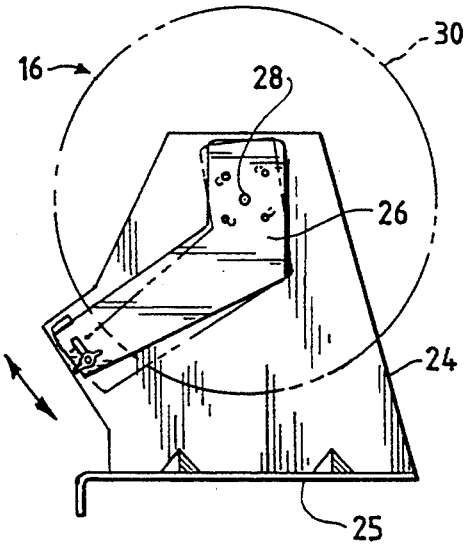
FIG. 3 is a cut away side view of the reel mounting assembly in FIG. 2.
Figure 2:
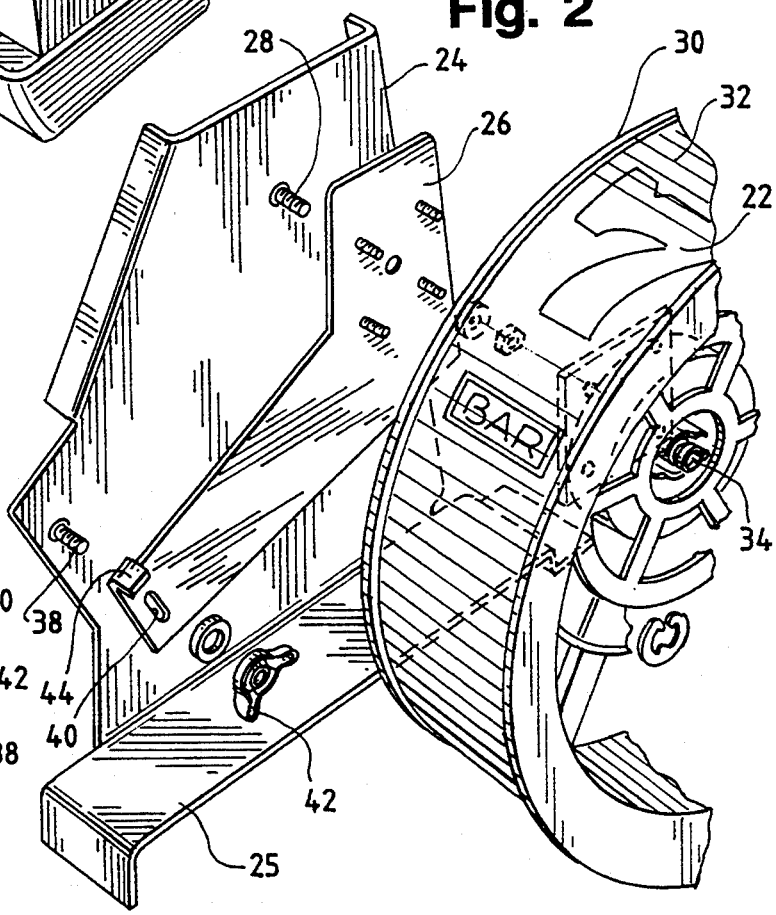
FIG. 2 is an exploded view of a reel mounting assembly according to an embodiment of this invention.

As shown in FIGS. 2 and 3, a frame support member 24 is provided to support each of the reels 16 and is secured to the slot machine housing 12 by a bracket 25. A reel support member 26 is pivotally mounted to the frame support member 24 via an axle 28. The reel 16, comprised of a rim 30 supporting a reel strip 32 having the play symbols 22 printed on the outer surface, is attached to a motor drive shaft 34 which is mounted on the reel support member 26.

The pivotable reel support member 26 provides a mechanism for adjusting the rotational position of the mounted reels 16 so as to rotationally align the play symbols 22 on the reels 16 with the pay line 20 when the reels 16 are stopped. To position the reel 16 with respect to the frame support member 24 thereby aligning the play symbols 22 on the reels 16 with the pay line 20, the pivotable reel support member 26 is rotated to change the angular position of the pivotable reel support member 26 over a predetermined range with respect to the frame support member 24. For example, FIG. 3 shows two different angular positions of the reel support member 26 as illustrated by a set of broken lines representing one angular position and a set of solid lines representing a second angular position.

Figure 4:
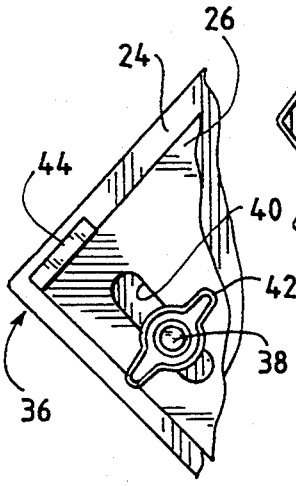
FIG. 4 is a partial enlarged view of the fastener mechanism shown in FIG. 3.

The rotational position of the reel support member and hence the play symbols 22 with respect to the frame support member 24, can be adjusted by utilizing an adjustment mechanism shown generally at 36. It is readily evident that a variety of mechanisms 36, capable of adjusting the position of the reel support member 26, can be utilized in conjunction with this embodiment of the invention. But in the preferred embodiment, as shown in FIGS. 3 and 4, the adjustment mechanism 36 includes a threaded bolt or pin 38 mounted to the frame support member and inserted through an arcuate slot 40 in the reel support member 26. To retain the angular position of the reel support member 26, an internally threaded wing nut 42 is threaded onto the bolt 38 until the wing nut 42 firmly abuts the reel support member 26, thereby preventing angular movement of the reel support member 26. The rotational position of the reel 16 can be adjusted by simply loosing the wing nut 42 and using an adjustment tab member 44 mounted on the front of the reel support member 26 to rotate the reel support member 26 with respect to the frame support member 24.

In another embodiment of the invention (not shown in the drawings), the adjustment mechanism 36 includes a threaded bolt or pin 38 mounted to the reel support member 26 and inserted through an arcuate slot 40 in the frame support member 24. To retain the angular position of the reel support member 26, an internally threaded wing nut 42 is threaded on to the bolt 38 until the wing nut 42 firmly abuts the frame support member 24, thereby preventing angular movement of the reel support member 26. The rotational position of the reel 16 can be adjusted by simply loosing the wing nut 42 and using an adjustment tab member 44 mounted on the front the reel support member 26 to rotate the reel support member 26 with respect to the frame support member The predetermined range of angular positions through which the reel support member 26 can be adjusted is determined by the size of the arcuate slot 40. As the length of the slot 40 is increased, the range of angular positions of the reel support member 26 is increased.

This invention provides substantial advantages in that the play symbols 22 can be adjusted simply by opening the front of the housing 12, loosening the wing nut 42 and using the adjustment member 44 to rotate the reel support member 26. In addition, the adjustment tab member 44 replaces the tools required to adjust other reel mounting assemblies.

Whereas the present invention has been described with respect to specific embodiments thereof, it will be understood that various changes and modifications will be suggested to one skilled in the art and it is intended that the invention encompass such changes and modifications as fall within the scope of the appended claims.

We claim:

1. A reel mounting assembly for use with a slot machine having a housing which includes a pay line located on a reel display window comprising:

a frame support member;

a reel support member pivotally connected to said frame support member;

an axle secured to said reel support member;

a reel having play symbols located on its periphery secured to said axle; and adjustment means for selectively securing over a predetermined range of angular positions said reel support member to said frame support member thereby permitting adjustment of the position of said play symbols with respect to the pay line, wherein said adjustment means includes a pin mounted on said frame support member and said reel support member includes an arcuate slot for receiving said pin, and said adjustment means further includes a fastener connected to said pin.

2. The assembly of claim 1 wherein said adjustment means includes an adjustment tab secured to the from side of said reel support member.

3. The assembly of claim 1 wherein at least a portion of said pin is threaded and said fastener is a wing nut.

4. A reel mounting assembly for use with a slot machine having a housing which includes a pay line located on a reel display window comprising:

a frame support member;

a reel support member pivotally connected to said frame support member;

an axle secured to said reel support member;

a reel having play symbols located on its periphery secured to said axle: and adjustment means for selectively securing over a predetermined range of angular positions said reel support member to said frame support member thereby permitting adjustment of the position of said play symbols with respect to the pay line, wherein said adjustment means includes a pin mounted on said reel support member and said frame support member includes an arcuate slot for engaging said pin, and said adjustment means further includes a fastener connected to said pin.

5. The assembly of claim 4 wherein said adjustment means includes an adjustment tab secured to said front side of said reel support member.

6. The assembly of claim 4 wherein at least a portion of said pin is threaded and said fastener is a wing nut.

7. A reel mounting assembly for use with a slot machine having a housing which includes a pay line located on a reel display window comprising:

a frame support member;

a reel support member pivotally connected to said frame support member;

a motor, having a drive shaft, secured to said reel support member;

a reel having play symbols located on its periphery secured to said motor drive shaft; and adjustment means for selectively securing over a predetermined range of angular positions said reel support member to said frame support member thereby permitting adjustment of the position of said play symbols with respect to the pay line, wherein said adjustment means includes a pin mounted on said frame support member and said reel support member includes an arcuate slot for receiving said pin, and said adjustment means further includes a fastener connected to said pin.

8. The assembly of claim 7 wherein said adjustment means includes an adjustment tab secured to the front side of said reel support member.

9. The assembly of claim 7 wherein at least a portion of said pin is threaded and said fastener is a wing nut.

10. A reel mounting assembly for use with a slot machine having a housing which includes a pay line located on a reel display window comprising:

a frame support member:

a reel support member pivotally connected to said frame support member;

a motor, having a drive shaft, secured to said reel support member;

a reel having play symbols located on its periphery secured to said motor drive shaft; and adjustment means for selectively securing over a predetermined range of angular positions said reel support member to said frame support member thereby permitting adjustment of the position of said play symbols with respect to the pay line, wherein said adjustment means includes a pin mounted on said reel support member and said frame support member includes an arcuate slot for engaging said pin, and said adjustment means further includes a fastener connected to said pin.

11. The assembly of claim 10 wherein said adjustment means includes an adjustment tab secured to said front side of said reel support member.

12. The assembly of claim 10 wherein at least a portion of said pin is threaded and said fastener is a wing nut.

* * * * *

UNITED STATES PATENT AND TRADEMARK OFFICE

CERTIFICATE OF CORRECTION

PATENT NO. : 5,423,540

DATED : June 13, 1995

INVENTOR(S) : Thomas N. Taxon

It is certified that error appears in the above-identified patent and that said Letters Patent is hereby corrected as shown below:

Column 3, line 1, after "member" insert -- 24 --

Column 3, line 27, after "member" insert -- 24. --

Column 4, Claim 2, line 2, delete "from" and insert -- front --

Signed and Sealed this

Twenty-second Day of August, 1995

Bruce Lehman

*Attest:*

BRUCE LEHMAN

*Attesting Officer*

*Commissioner of Patents and Trademarks*